US005847325A

United States Patent [19]

Gagne

[11] Patent Number: 5,847,325

[45] Date of Patent: Dec. 8, 1998

[54] ELECTRICAL INSULATOR HAVING SHEDS

[76] Inventor: Serge Gagne, 33 rue Landry, Iberville, Quebec, Canada, J2X 4V4

[21] Appl. No.: 897,246

[22] Filed: Jul. 18, 1997

Related U.S. Application Data

[63] Continuation-in-part of Ser. No. 625,594, Apr. 3, 1996, abandoned.

[51] Int. Cl.[6] ..... H01B 17/02

[52] U.S. Cl. ..... 174/179

[58] Field of Search ..... 174/179, 178, 174/137 B, 189

[56] References Cited

U.S. PATENT DOCUMENTS

| | | | |
|---|---|---|---|
| 4,312,123 | 1/1982 | Wheeler | 29/631 |
| 4,373,113 | 2/1983 | Winkler et al. | 174/179 |
| 4,604,498 | 8/1986 | Kuhl | 174/140 S |
| 5,091,478 | 2/1992 | Saltman | 525/179 |
| 5,221,781 | 6/1993 | Aida et al. | 524/433 |
| 5,556,919 | 9/1996 | Oyama et al. | 525/189 |
| 5,597,867 | 1/1997 | Tsujimoto et al. | 525/74 |

FOREIGN PATENT DOCUMENTS

| | | | |
|---|---|---|---|
| 2200502 | 8/1988 | United Kingdom | 174/179 |

*Primary Examiner*—Nestor Ramirez
*Assistant Examiner*—Joseph Wakj
*Attorney, Agent, or Firm*—Eric Fincham

[57] ABSTRACT

A composite electrical insulator suitable for high tension open air use wherein the insulator has an interior structural rod of an electrically insulating material and an outer coating formed of a thermoplastic material and having a plurality of radially extending sheds formed integrally therewith, the outer coating terminating adjacent the ends of the interior rod, the coating having at least two radially extending abutting surfaces formed to abut against mating abutting surfaces formed on an end fitting. The insulator provides good mechanical properties while being light weight and meeting all electrical requirements.

17 Claims, 2 Drawing Sheets

ELECTRICAL INSULATOR HAVING SHEDS

The present application is a continuation-in-part of application Ser. No. 08/625,594 filed Apr. 3, 1996.

BACKGROUND OF THE INVENTION

The present invention relates to composite insulators and more particularly, relates to composite insulators suitable for high-tension, open-air use.

Many different types of electrical insulators suitable for high-tension open-air use are known in the art. Generally, they fall into two different classes—a first being one in which the insulators are generally of a relatively homogeneous material and the second being one wherein two or more materials are used for different functions. These latter are generally called composite insulators.

Insulators of a single material were widely used by electrical utilities for a number of years. Generally they are of a ceramic or porcelain material. While porcelain is a very suitable material due to its resistance to damage by electrical discharges, weathering and chemicals, it is relatively heavy and can shatter on impact. Thus, there have been cases of severe injury resulting from the shattering of porcelain insulators. In some places, they are damaged due to people deliberately throwing objects at the insulators or even shooting at them.

The deficiencies of the porcelain insulators has led to the development of composite insulators which generally comprise a central core covered by an outer insulating coating. The central core is provided to perform the mechanical function of the insulator while the protective coating is provided to protect the central core from external agents and to prevent electrical discharge.

Composite insulators for high-tension use must conform to specific electrical requirements. Thus, the carrier rod must be electrically insulating in its axial direction and the insulating layer must be secured thereto in a manner that no electrical conduction can occur at the seam between the insulating cover and the interior carrier rod. The insulating cover performs several functions including providing resistance to weathering, UV, ozone, etcetera. The cover should also have good mechanical resistance to cold and good electrical tracking resistance. Desirably the insulating cover should be flexible, halogen-free and flame retardant.

While many composite insulations have been proposed in the art, they have generally not received wide acceptance because they have not shown that they retain the required properties over an extended period of time i.e. they have tended to degrade. It is believed that at least a portion of the problems relates to the sealing between the internal rod and the external insulating cover. The weakness has been found to be the point at which the end fittings are attached to the insulator.

SUMMARY OF THE INVENTION

It is accordingly an object of the present invention to provide the composite insulator which is both light weight and can meet the electrical and mechanical requirements of electrical utilities for insulators.

It is a further object of the present invention to provide a composite insulator wherein a thermoplastic material is used as an outer covering.

It is a further object of the present invention to provide a composite insulator wherein end pieces are securely fitted to the insulator to overcome problems of moisture infiltration.

It is a further object of the present invention to provide a composite insulator wherein a recyclable thermoplastic material is used as an outer covering.

According to one aspect of the present invention, there is provided a composite insulator for use with a first end fitting, the insulator comprising an interior elongated structural rod of an electrically insulating material, the rod having first and second opposed ends, and an outer coating about the structural rod, the outer coating terminating short of the first end to thereby provide a first uncoated rod end portion on which the first end fitting is adapted to be mounted. The outer coating has a plurality of radially extending sheds integrally formed therewith. The outer coating also has a first axially extending reduced thickness portion adjacent the first uncoated rod end portion with a first abutting surface extending between the first uncoated rod end portion and the first axially extending reduced thickness portion and a second abutting surface extending between the first axially extending reduced thickness portion and the outer coating, each of the first and second abutting surfaces have been designed to abut a respective mating surface on the first end fitting. The outer coating is formed of a thermoplastic elastomer comprising a blend of a polyolefin resin with an olefin copolymer rubber wherein the rubber is in the form of small particles of cured rubber in the resin matrix.

According to a further aspect of the present invention, there is provided a composite insulator for high voltage electrical installations, the insulator comprising an interior elongated structural rod of an electrically insulating material, the rod having first and second opposed ends, an outer coating about the structural rod, the coating terminating short of each of the opposed ends to thereby provide uncoated rod end portions. There is also provided first and second end fittings each having a recess formed therein, each of the end fittings being mounted on a respective one end of the structural rod such that the uncoated rod end portions each fits within a corresponding one of the recesses, each of the uncoated rod end portions having an arrangement wherein the outer coating has an axially extending reduced thickness portion adjacent each of the uncoated rod end portions with a first abutting surface extending between the uncoated rod end portion and a respective axially extending reduced thickness portion and a second abutting surface extending between the axially extending reduced thickness portion and the outer coating. Each of the end fittings also has mating abutting surfaces formed within the recesses designed to abut the first and second abutting surfaces with the outer coating being formed of a thermoplastic elastomer.

In greater detail, the internal rod or core of the composite insulator of the present invention may be formed of any number of suitable materials having the desired insulating and mechanical properties required. Typically, it would include a central core of fibers such as resin coated fibers. It is conventional that the interior rod or core be of a cylindrical configuration.

The outer coating is preferably molded onto the interior core and is of a thermoplastic material. Conventionally, thermoplastic materials have not been utilized as they have a relatively low melting point. However, the design of the insulator of the present invention permits the use of a thermoplastic material which provides numerous advantages such as ease of handling and the capability of recycling.

In the preferred embodiment of the invention, there outer insulating cover is formed of a thermoplastic material. Conventionally, such thermoplastic materials have not been employed as they have a relatively low melting point.

However, with the present invention, it has been found that a thermoplastic material may be utilized.

The preferred type of thermoplastic elastomer comprises a blend of a polyolefin resin, an olefin copolymer rubber, in which the rubber is in the form of small particles of cured rubber in the resin matrix. As will be understood by those knowledgeable in the art, one could include conventional additives such as flame retardant compounds. The product is preferably halogen free.

A particularly preferred material is that sold under the trademark Dytron 7600-40 and which is supplied by Advanced Elastomer Systems.

The outer coating is molded to preferably have a plurality of spaced apart sheds formed thereon as is known in the art. In a preferred embodiment, the sheds are formed as annular rings having a substantially uniform thickness. In conventional insulators, the sheds usually have a frustoconical configuration whereas in the practise of the present invention, the sheds may be formed to be relatively thin in the form of an annular ring having a substantially uniform thickness. The thickness of the rings may vary; a preferred thickness is between 1.0 mm and 20 mm and even more preferred, is a thickness of between 1.25 and 10 mm.

As is conventional, the composite insulator is adapted to receive an end fitting at one or both ends thereof. The type of end fitting may vary depending upon the particular use.

According to the practice of the present invention, and in the preferred embodiment thereof, the insulator has its outer coating terminating at a point short of an end of the interior elongated structural rod. It is on this uncoated rod portion that the end fitting is placed. Conveniently, the end fitting may have an annular recess adapted to receive the central core or structural rod component of the composite insulator.

In a preferred embodiment, the end fitting has, on the inner surface of the annular recess, a plurality of annular grooves such that when the end fitting is attached by a crimping operation, the interface between the surface having the annular grooves and the structural rod will be enhanced.

According to the present invention, there are provided a plurality of generally radially extending mating abutting surfaces between the outer coating and the end fitting. With respect to the outer coating, one such radially extending abutting surface is formed at the point of termination of the coating with respect to the interior elongated structural rod. In order to provide at least one further radially extending abutting surface, at least one axially extending reduced thickness portion is formed in the outer coating adjacent its point of termination on the structural rod. At the point where the coating increases to its normal thickness, there is formed a second abutting surface.

A particularly preferred embodiment of the invention utilizes an adhesive between the core and the outer coating; the adhesive/sealant is preferably an amino silane monomer in a solvent of butyl isobutyl ketone.

At the point where the outer thermoplastic coating and the end fitting abut, one may use a silicon coating on the adjacent surfaces to assist in the sealing of the thermoplastic material with the metallic material of the end fitting.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
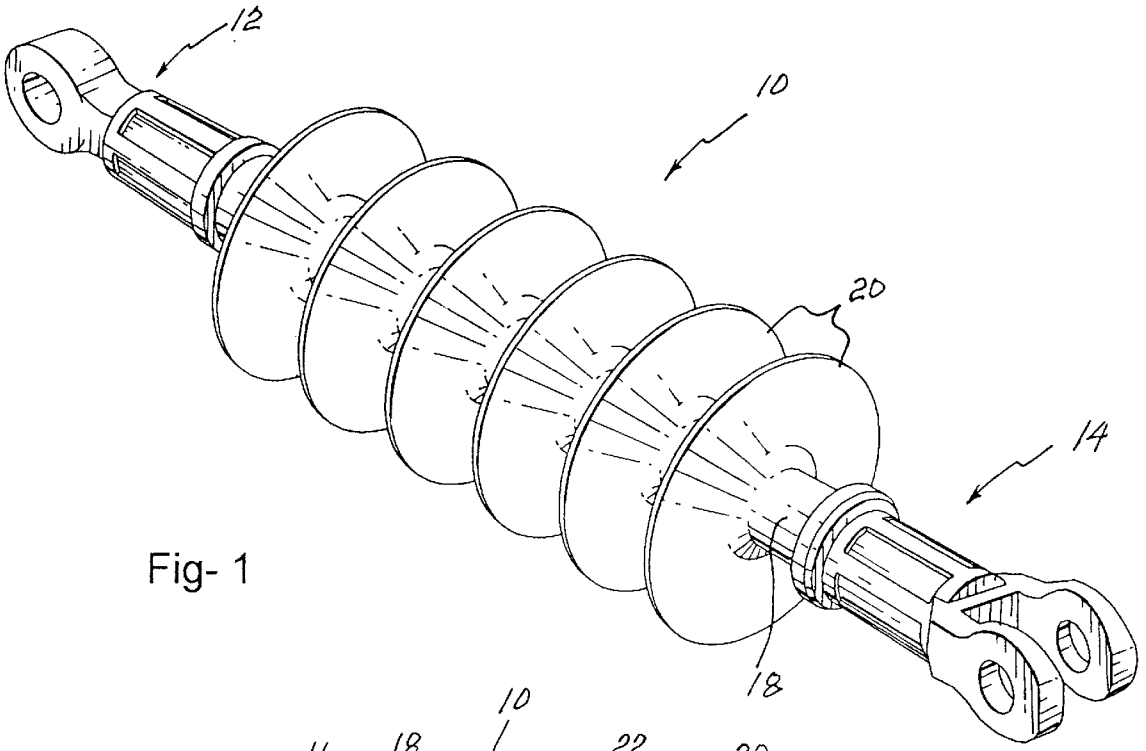
FIG. 1 is a perspective view of a composite insulator and associated end fittings according to the present invention.
Figure 2:
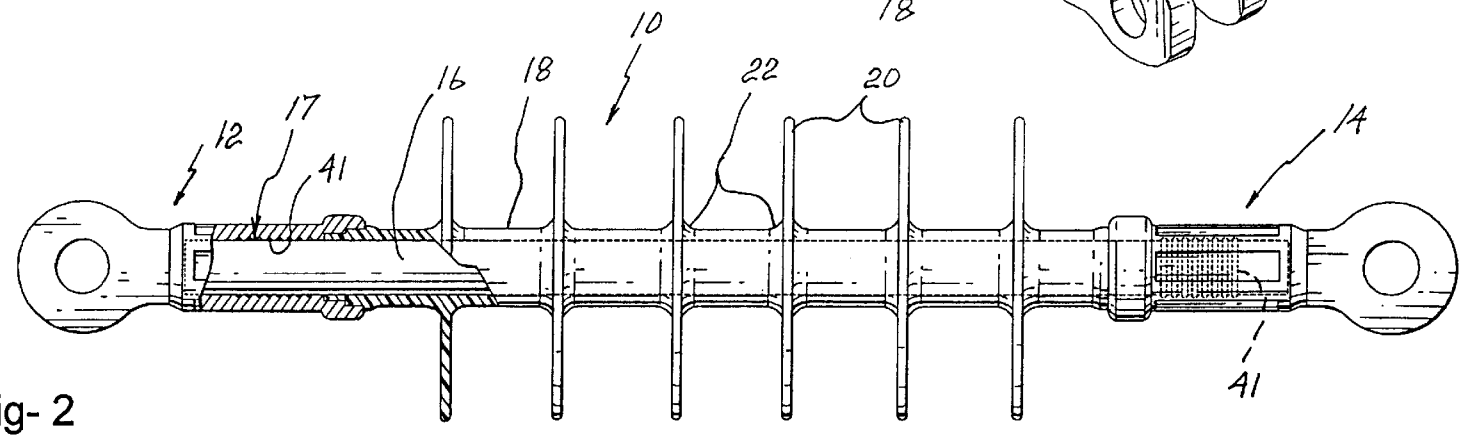
FIG. 2 is a side elevational view, partially in section, of the composite insulator of FIG. 1.

Referring to the drawings in greater detail, and by reference characters thereto, there is illustrated a composite insulator which is generally designated by reference numeral 10. Composite insulator has a first end fitting 12 at one end thereof and a second end fitting 14 at an opposed end.

Composite insulator 10 includes a central core 16 which is an elongated structural rod of an electrically insulating material. About central core 16 is an outer coating 18 of a thermoplastic material.

Formed integrally with outer coating 18 are a plurality of radially extending sheds 20. For molding purposes, there is provided a radius between the coating surrounding the central core 16 and sheds 20, the radius being generally designated by reference numeral 22 and which radius is preferably between approximately 2 mm and 6½ mm in order to avoid contraction problems.

Figure 3:
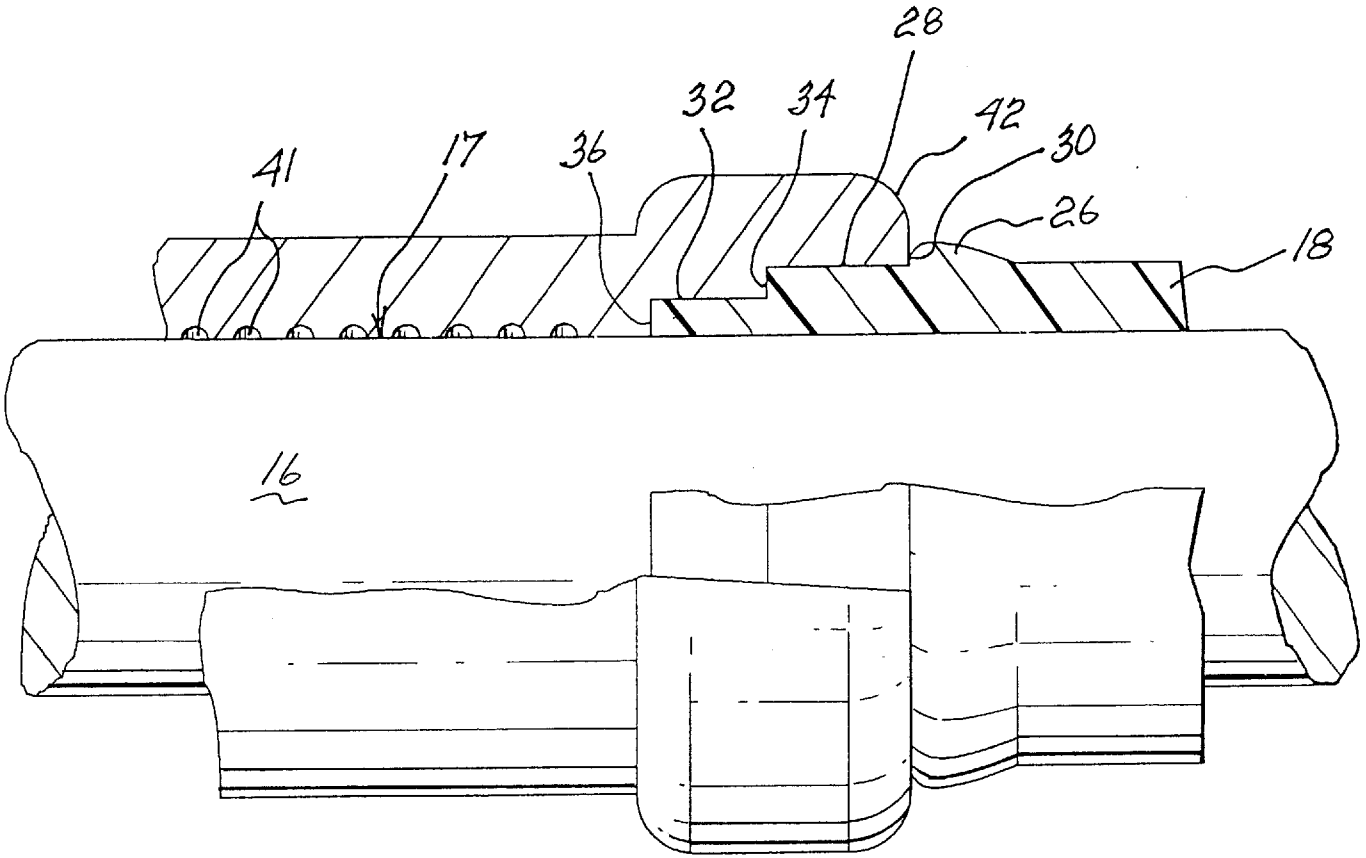
FIG. 3 is a detailed view of the interconnection between the end connector and insulator as shown in FIG. 2.

As may be best seen in FIG. 3, central core 16 has, at one end thereof, an uncoated rod end portion 17. Provided on uncoated rod end portion are a plurality of ridges or annular rings 41 for reasons which will become apparent hereinafter.

The termination of outer coating 18 provides a first abutting surface 36 which extends between central core 16 and an axially extending reduced thickness portion 32. A second abutting surface 34 extends from axially extending reduced thickness portion 32 outwardly to the normal thickness of outer coating 18.

End fitting 12 has an annular recess designed to receive the end of central core 16. End fitting 12, as is known in the art, preferably utilizes a slightly enlarged section forming a sacrificial anode 42. As may be best seen in FIG. 3, the interior surface of the annular recess of end fitting 12 has mating abutting surfaces to abut against surfaces 36 and 34. Preferably, the arrangement is such that end fitting 12 exerts a slight pressure on outer coating 18 to slightly raise the surface thereof in the form of a bulge 26. Bulge 26 along with end wall 30 of end fitting 12 provides a further sealing. Also, a surface 28 of outer coating 18 seals against end fitting 12.

It will be understood that the above described embodiments are for purposes of illustration only and that changes and modifications may be made thereto without departing from the spirit and scope of the invention.

I claim:

1. A composite insulator for high voltage electrical installations, said insulator comprising an interior elongated structural rod of an electrically insulating material, said rod having first and second opposed ends, an outer coating about said structural rod, a plurality of integrally formed sheds extending outwardly from said outer coating, said coating terminating short of at least said first end to thereby provide an uncoated rod end portion, a first end fitting having a recess formed therein, said end fitting having an end wall about said recess, said first end fitting being mounted on said first end of said structural rod such that said uncoated rod end portion fits within said recess, said uncoated rod end portion having an arrangement wherein said outer coating has an axially extending reduced thickness portion adjacent said uncoated rod end portion, a first abutting surface extending between said uncoated rod end portion and said axially extending reduced thickness portion, a second abutting surface extending between said axially extending reduced thickness portion and said outer coating, said end fitting also having mating abutting surfaces formed within said recess designed to abut said first and second abutting surfaces, a bulge comprising an outwardly bulging portion formed in said outer coating adjacent said end wall of said end fitting, said outwardly bulging portion abutting a segment of said end wall of said end fitting with a remaining segment extending beyond said outwardly bulging portion, said outwardly bulging portion being formed when said end fitting is mounted on said first end of said structural rod, said outer coating being formed of a thermoplastic elastomer.

2. The insulator of claim 1 wherein said uncoated rod end portions include a plurality of annular rings formed thereon.

3. The insulator of claim 1 further including an adhesive coating between said interior rod and said outer coating.

4. The insulator of claim 2 including a sacrificial anode formed in said end fitting.

5. The insulator of claim 3 wherein said adhesive coating comprises an amino silane monomer adhesive dissolved in butyl isobutyl ketone.

6. The insulator of claim 1 wherein said outer coating is formed of a thermoplastic elastomer comprising a blend of a polyolefin resin with an olefin copolymer rubber wherein the rubber is in a form of small particles of cured rubber in a matrix of said resin.

7. The insulator of claim 1 wherein said sheds merge with said coating to form an arcuate section, said arcuate section having a radius of between 2 mm and 6.5 mm.

8. The insulator of claim 1 wherein said interior elongated structural rod is formed of resin coated fibers.

9. The insulator of claim 6 further including a silicone sealant on said first and second abutting surfaces.

10. The insulator of claim 8 wherein said sheds comprise a plurality of annular rings having a substantially uniform thickness of between 1.0 mm and 20 mm.

11. The insulator of claim 10 wherein said annular rings have a substantially uniform thickness of between 1.25 mm and 10 mm.

12. The insulator of claim 1 wherein said coating terminates short of said second end to thereby provide an uncoated second rod end portion, a second end fitting having a recess formed therein, said second end fitting being mounted on said second end of said rod such that said second uncoated rod end portion fits within said recess of said second end fitting, said outer coating having a second axially extending reduced thickness portion adjacent said second uncoated rod end portion, a first abutting surface extending between said second uncoated rod end portion and said second axially extending reduced thickness portion, a second abutting surface extending between said second axially extending reduced thickness portion and said outer coating, said second end fitting also having mating abutting surfaces formed within said recess to abut said first and second abutting surf aces, and a bulge comprising an outwardly bulging portion formed in said outer coating adjacent said end wall of said second end fitting, said outwardly bulging portion being formed when said second end fitting is mounted on said second end of said structural rod.

13. The insulator of claim 12 wherein said outer coating is formed of a thermoplastic elastomer comprising a blend of a polyolefin resin with an olefin copolymer rubber wherein the rubber is in a form of small particles of cured rubber in a matrix of said resin.

14. A composite insulator for high voltage electrical installations, said insulator comprising an interior elongated structural rod of an electrically insulating material, said rod having first and second opposed ends, an outer coating about said structural rod, said coating terminating short of at least said first end to thereby provide an uncoated rod end portion, a first end fitting having a recess formed therein, said end fitting having an end wall about said recess, said first end fitting being mounted on said first end of said structural rod such that said uncoated rod end portion fits within said recess, said outer coating having an axially extending reduced thickness portion adjacent said uncoated rod end portion, a first abutting surface extending between said uncoated rod end portion and said axially extending reduced thickness portion, a second abutting surface extending between said axially extending reduced thickness portion and said outer coating, said end fitting also having mating abutting surfaces formed within said recess designed to abut said first and second abutting surfaces, said outer coating having a plurality of radially extending sheds integrally formed therewith, said sheds comprising a plurality of annular rings each having a substantially uniform thickness.

15. The insulator of claim 14 wherein said rings have a thickness of between 1.0 mm and 20 mm.

16. The insulator of claim 15 wherein said ring thickness is between 1.25 mm and 10 mm.

17. The insulator of claim 14 wherein said coating terminates short of said second end to thereby provide an uncoated second rod end portion, a second end fitting having a recess formed therein, said second end fitting being mounted on said second end of said rod such that said second uncoated rod end portion fits within said recess of said second end fitting.

* * * * *